US008053058B2

(12) United States Patent
Harada et al.

(10) Patent No.: US 8,053,058 B2
(45) Date of Patent: Nov. 8, 2011

(54) SPRAY-COATED MEMBER HAVING AN EXCELLENT RESISTANCE TO PLASMA EROSION AND METHOD OF PRODUCING THE SAME

(75) Inventors: Yoshio Harada, Hyogo (JP); Kenichiro Togoe, Hyogo (JP); Fujio Kushiki, Fukuoka (JP)

(73) Assignee: Tocalo Co., Ltd., Hyogo (JP)

( * ) Notice: Subject to any disclaimer, the term of this patent is extended or adjusted under 35 U.S.C. 154(b) by 0 days.

(21) Appl. No.: 12/758,940

(22) Filed: Apr. 13, 2010

(65) Prior Publication Data

US 2010/0203288 A1 Aug. 12, 2010

Related U.S. Application Data

(62) Division of application No. 11/469,051, filed on Aug. 31, 2006, now Pat. No. 7,767,268.

(30) Foreign Application Priority Data

Sep. 8, 2005 (JP) ..... 2005-260294

(51) Int. Cl.

| | |
|---|---|
| ***B32B 3/00*** | (2006.01) |
| ***B32B 9/04*** | (2006.01) |
| ***B32B 15/04*** | (2006.01) |
| ***B32B 5/00*** | (2006.01) |

(52) U.S. Cl. ..... 428/141; 428/701; 428/702; 428/332

(58) Field of Classification Search ..... None
See application file for complete search history.

(56) References Cited

U.S. PATENT DOCUMENTS

| | | | | |
|---|---|---|---|---|
| 3,663,793 | A | | 5/1972 | Petro et al. |
| 3,990,860 | A | | 11/1976 | Fletcher et al. |
| 4,000,247 | A | | 12/1976 | Yamada et al. |
| 4,205,051 | A | | 5/1980 | Takahashi et al. |
| 4,219,359 | A | | 8/1980 | Miwa et al. |
| 4,536,228 | A | | 8/1985 | Treharne |
| 4,997,809 | A | | 3/1991 | Gupta |
| 5,004,712 | A | | 4/1991 | Borglum |
| 5,024,992 | A | | 6/1991 | Morris |
| 5,032,248 | A | | 7/1991 | Kanamaru et al. |
| 5,057,335 | A | | 10/1991 | Hanagata et al. |
| 5,093,148 | A | | 3/1992 | Christodoulou et al. |
| 5,128,316 | A | | 7/1992 | Agostinelli et al. |
| 5,180,322 | A | * | 1/1993 | Yamamoto et al. ..... 445/37 |
| 5,206,059 | A | | 4/1993 | Marantz |

(Continued)

FOREIGN PATENT DOCUMENTS

| | | |
|---|---|---|
| AU | 2001-164354 | 6/2001 |

(Continued)

OTHER PUBLICATIONS

Spray Coating Technical Manual, Series of JIS Manual, edited by M. Magome, issued by Japan Standards Association, Oct. 30, 1998, excerpt, translation p. 33.

(Continued)

*Primary Examiner* — Jennifer McNeil
*Assistant Examiner* — Vera Katz
(74) *Attorney, Agent, or Firm* — Greenblum & Bernstein, P.L.C.

(57) ABSTRACT

A spray coated member having an excellent resistance to plasma erosion is produced by irradiating an electron beam to an outermost surface layer portion of a ceramic spray coated portion covering a surface of a substrate to form an electron beam irradiated layer.

4 Claims, 1 Drawing Sheet

U.S. PATENT DOCUMENTS

| | | | |
|---|---|---|---|
| 5,316,859 | A | 5/1994 | Harada et al. |
| 5,366,585 | A | 11/1994 | Robertson et al. |
| 5,397,650 | A | 3/1995 | Harada et al. |
| 5,427,823 | A | 6/1995 | Varshney et al. |
| 5,432,151 | A | 7/1995 | Russo et al. |
| 5,472,793 | A | 12/1995 | Harada et al. |
| 5,562,840 | A | 10/1996 | Swain et al. |
| 5,909,354 | A | 6/1999 | Harada et al. |
| 5,922,275 | A | 7/1999 | Kageyama et al. |
| 6,010,966 | A | 1/2000 | Ionov |
| 6,045,665 | A | 4/2000 | Ohhashi et al. |
| 6,120,640 | A | 9/2000 | Shih et al. |
| 6,132,890 | A | 10/2000 | Harada et al. |
| 6,180,259 | B1 | 1/2001 | Harada et al. |
| 6,250,251 | B1 | 6/2001 | Akiyama et al. |
| 6,261,962 | B1 | 7/2001 | Bhardwaj et al. |
| 6,265,250 | B1 | 7/2001 | Yu |
| 6,306,489 | B1 | 10/2001 | Hellmann et al. |
| 6,319,419 | B1 | 11/2001 | Ohhashi et al. |
| 6,326,063 | B1 | 12/2001 | Harada et al. |
| 6,383,964 | B1 | 5/2002 | Nakahara et al. |
| 6,447,853 | B1 | 9/2002 | Suzuki et al. |
| 6,451,647 | B1 | 9/2002 | Yang et al. |
| 6,509,070 | B1 | 1/2003 | Voevodin et al. |
| 6,547,921 | B2 | 4/2003 | Suzuki et al. |
| 6,558,505 | B2 | 5/2003 | Suzuki et al. |
| 6,576,354 | B2 | 6/2003 | Tsukatani et al. |
| 6,586,348 | B2 | 7/2003 | Hartner et al. |
| 6,641,941 | B2 | 11/2003 | Yamada et al. |
| 6,733,843 | B2 | 5/2004 | Tsukatani et al. |
| 6,738,863 | B2 | 5/2004 | Butterworth et al. |
| 6,771,483 | B2 | 8/2004 | Harada et al. |
| 6,777,045 | B2 | 8/2004 | Lin et al. |
| 6,783,863 | B2 | 8/2004 | Harada et al. |
| 6,797,957 | B2 | 9/2004 | Kawakubo et al. |
| 6,805,968 | B2 | 10/2004 | Saito et al. |
| 6,834,613 | B1 | 12/2004 | Miyazaki et al. |
| 6,852,433 | B2 | 2/2005 | Maeda |
| 6,884,516 | B2 | 4/2005 | Harada et al. |
| 6,916,534 | B2 | 7/2005 | Wataya et al. |
| 7,494,723 | B2 | 2/2009 | Harada et al. |
| 7,497,598 | B2 | 3/2009 | Masaki et al. |
| 7,648,782 | B2 | 1/2010 | Kobayashi et al. |
| 7,767,268 | B2 | 8/2010 | Harada et al. |
| 7,850,864 | B2 | 12/2010 | Kobayashi |
| 2002/0018902 | A1 | 2/2002 | Tsukatani et al. |
| 2002/0177014 | A1 | 11/2002 | Kaneyoshi et al. |
| 2002/0192429 | A1 | 12/2002 | Takai et al. |
| 2004/0061431 | A1 | 4/2004 | Takeuchi et al. |
| 2004/0214026 | A1 | 10/2004 | Harada et al. |
| 2004/0216667 | A1 | 11/2004 | Mitsuhashi et al. |
| 2005/0103275 | A1 | 5/2005 | Sasaki et al. |
| 2005/0106869 | A1 | 5/2005 | Ooyabu et al. |
| 2005/0136188 | A1 | 6/2005 | Chang |
| 2005/0147852 | A1 | 7/2005 | Harada et al. |
| 2006/0099444 | A1 | 5/2006 | Moriya et al. |
| 2006/0099457 | A1 | 5/2006 | Moriya et al. |
| 2006/0121293 | A1 | 6/2006 | Boutwel et al. |
| 2006/0183344 | A1 | 8/2006 | Escher et al. |
| 2007/0026246 | A1 | 2/2007 | Harada et al. |
| 2007/0054092 | A1 | 3/2007 | Harada et al. |
| 2007/0166477 | A1 | 7/2007 | Chang |
| 2007/0215283 | A1 | 9/2007 | Kobayashi et al. |
| 2007/0218302 | A1 | 9/2007 | Kobayashi et al. |
| 2009/0120358 | A1 | 5/2009 | Harada et al. |
| 2009/0130436 | A1 | 5/2009 | Harada et al. |
| 2009/0208667 | A1 | 8/2009 | Harada et al. |
| 2010/0068395 | A1 | 3/2010 | Moriya et al. |

FOREIGN PATENT DOCUMENTS

| | | | |
|---|---|---|---|
| EP | 0 822 584 | | 2/1998 |
| EP | 1 156 130 | | 11/2001 |
| JP | 50-075370 | | 6/1975 |
| JP | 50-75370 | | 6/1975 |
| JP | 58-192661 | | 11/1983 |
| JP | 58-202535 | | 11/1983 |
| JP | 59-96273 | | 6/1984 |
| JP | 61-30658 | | 2/1986 |
| JP | 61-030658 | | 2/1986 |
| JP | 61-104062 | | 5/1986 |
| JP | 61-113755 | | 5/1986 |
| JP | 61104062 | * | 5/1986 |
| JP | 62-253758 | | 11/1987 |
| JP | 64-039728 | | 2/1989 |
| JP | 01-139749 | | 6/1989 |
| JP | 1-139749 | | 6/1989 |
| JP | 3-115535 | | 5/1991 |
| JP | 3-247769 | | 11/1991 |
| JP | 4-202660 | | 7/1992 |
| JP | 4-276059 | | 10/1992 |
| JP | 05-117064 | | 5/1993 |
| JP | 5-117064 | | 5/1993 |
| JP | 05-238859 | | 9/1993 |
| JP | 5-238859 | | 9/1993 |
| JP | 6-057396 | | 3/1994 |
| JP | 06-057396 | | 3/1994 |
| JP | 6-136505 | | 5/1994 |
| JP | 06-136505 | | 5/1994 |
| JP | 06-142822 | | 5/1994 |
| JP | 06-196421 | | 7/1994 |
| JP | 6-196421 | | 7/1994 |
| JP | 6-220618 | | 8/1994 |
| JP | 7-35568 | | 4/1995 |
| JP | 7-035568 | | 4/1995 |
| JP | 7-102366 | | 4/1995 |
| JP | 07-126827 | | 5/1995 |
| JP | 07-176524 | | 7/1995 |
| JP | 7-176524 | | 7/1995 |
| JP | 08-037180 | | 2/1996 |
| JP | 8-037180 | | 2/1996 |
| JP | 8-339895 | | 12/1996 |
| JP | 08-339895 | | 12/1996 |
| JP | 9-048684 | | 2/1997 |
| JP | 09-048684 | | 2/1997 |
| JP | 9-67632 | * | 3/1997 |
| JP | 09-069554 | | 3/1997 |
| JP | 9-069554 | | 3/1997 |
| JP | 9-216075 | | 8/1997 |
| JP | 09-216075 | | 8/1997 |
| JP | 09-272987 | | 10/1997 |
| JP | 9-316624 | | 12/1997 |
| JP | 09-316624 | | 12/1997 |
| JP | 10-004083 | | 1/1998 |
| JP | 10-045461 | | 2/1998 |
| JP | 10-045467 | | 2/1998 |
| JP | 10-144654 | | 5/1998 |
| JP | 10-163180 | | 6/1998 |
| JP | 10-202782 | | 8/1998 |
| JP | 10-226869 | | 8/1998 |
| JP | 10-330971 | | 12/1998 |
| JP | 11-080925 | | 3/1999 |
| JP | 11-207161 | | 8/1999 |
| JP | 11-345780 | | 12/1999 |
| JP | 2000-54802 | | 2/2000 |
| JP | 2000-72529 | | 3/2000 |
| JP | 2000-072529 | | 3/2000 |
| JP | 3076768 | | 6/2000 |
| JP | 2000-191370 | | 7/2000 |
| JP | 2000-228398 | | 8/2000 |
| JP | 2001-031484 | | 2/2001 |
| JP | 2001-164354 | | 6/2001 |
| JP | 2001164354 | * | 6/2001 |
| JP | 2001-335915 | | 12/2001 |
| JP | 2001-342553 | | 12/2001 |
| JP | 2002-80954 | | 3/2002 |
| JP | 2002-080954 | | 3/2002 |
| JP | 2002-89607 | | 3/2002 |
| JP | 2002-089607 | | 3/2002 |
| JP | 2003-95649 | | 4/2003 |
| JP | 2003-095649 | | 4/2003 |
| JP | 2003-264169 | | 9/2003 |
| JP | 2003-321760 | | 11/2003 |

| | | |
|---|---|---|
| JP | 2004-003022 | 1/2004 |
| JP | 2004-010981 | 1/2004 |
| JP | 2004-149915 | 5/2004 |
| JP | 2004-190136 | 7/2004 |
| JP | 2004-522281 | 7/2004 |
| JP | 2004-269951 | 9/2004 |
| JP | 2005-256098 | 9/2005 |
| JP | 2006-118053 | 5/2006 |
| JP | 2007-516921 | 6/2007 |
| JP | 2007-314886 | 12/2007 |
| KR | 10-0248081 | 4/2000 |
| KR | 10-0268052 | 10/2000 |
| KR | 2002-3367 | 1/2002 |
| KR | 10-2007-0030718 | 3/2007 |
| KR | 2007-30718 | 3/2007 |
| WO | 01/42526 | 6/2001 |
| WO | 03/003404 | 1/2003 |
| WO | 2004/095532 | 11/2004 |
| WO | 2005-062758 | 7/2005 |
| WO | 2007/013184 | 2/2007 |
| WO | 2007/023971 | 3/2007 |
| WO | 2007/023976 | 3/2007 |

OTHER PUBLICATIONS

ISO 4287: Geometrical Product Specifications (GPS)—Surface texture: Profile method—Terms, definitions and surface texture parameters. 1997; with English language translation published as B 0601: Geometrical Product Specifications (GPS)—Surface texture: Profile method—Terms, definitions and surface texture parameters. 2001.

SURFCOM 1400D/1400D-3DF, published by Tokyo Semitsu Co., Ltd., Jan. 8, 2000, pp. 19, 230-237, 260 and 261.

JIS Using Series, "Spraying Techniques Manual," Oct. 30, 1998, Japanese Standard Association, p. 95; together with an English language translation thereof.

English language Abstract of JP 64-039728.

English language Abstract of JP 01-139749.

English language Abstract of JP 03-115535.

U.S.A. Office Action for U.S. Appl. No. 12/293,974, mailed Apr. 5, 2011.

Magome, Masakatsu, "The p. 33 of Spray Coating Technical Manual," Series of JIS Manual, issued by Japanese Standards Association on Oct. 30, 1998, 7 pages including English translation.

* cited by examiner

SPRAY-COATED MEMBER HAVING AN EXCELLENT RESISTANCE TO PLASMA EROSION AND METHOD OF PRODUCING THE SAME

CROSS-REFERENCE TO RELATED APPLICATIONS

This application is a divisional of U.S. patent application Ser. No. 11/469,051, filed Aug. 31, 2006, the contents of which are expressly incorporated by reference in its entirety, which claims priority to Japanese Application No. JP 2005-260294, filed Sep. 8, 2005.

BACKGROUND OF THE INVENTION

1. Field of the Invention

This invention relates to a member used in a thin film forming apparatus, a plasma treating apparatus or the like in a semiconductor processing process and a method of producing the same, and more particularly to a spray-coated member having an excellent resistance to plasma erosion, which is used as a member for a container used in the plasma processing under an environment containing a halogen compound, for example, a containing used in vacuum deposition, ion plating, sputtering, chemical deposition, laser precision working, plasma sputtering or the like, and a method of producing the same.

2. Description of Related Art

In the semiconductor processing process, there is a step of forming a thin film of a metal, a metal oxide, a nitride, a carbide, a boride, a silicide or the like. In this step is used a thin film-forming apparatus for vacuum deposition, ion plating, sputtering, plasma CVD or the like (e.g. JP-A-50-75370).

When the thin film is formed with such an apparatus, a thin film forming material adheres onto surfaces of various jigs or constituents used in the apparatus. When the adhesion amount of the thin film forming material onto the jig or the constituent is small, the troubles are hardly caused. However, the time of forming the thin film becomes recently long, and hence the adhesion amount of particles to the jig or the constituent increases, and also the change of temperature in the operation and the variation of mechanical load to the jig or the constituent become large. As a result, there is caused a problem that a part of the particles as a main component of the thin film adhered to the surface of the jig or constituent during the formation of the thin film is adhered to a semiconductor wafer through the peeling and scattering to deteriorate the quality of the product.

As to the various constituents used in the aforementioned apparatuses, the following methods are proposed as a technique of preventing the peeling of the thin film-forming particles adhered to the surface of the constituent. For example, JP-A-58-202535 and JP-B-7-35568 disclose a technique that the surface of the jig or the constituent is subjected to a sand blasting and further to a horning or knitting to roughen the surface to thereby increase the surface area effective for preventing the peeling and scattering of the adhered thin-film particles.

JP-A-H03-247769 discloses a technique that U-shaped grooves or V-shaped grooves are periodically formed on the surface of the jig or the constituent at intervals of not more than 5 mm to suppress the peeling of the thin film forming particles.

JP-A-H04-202660 and JP-A-H07-102366 disclose a technique that TiN coating is formed on the surface of the constituent or further a fusion plated coating of Al or Al alloy is formed thereon. Also, JP-A-H06-220618 discloses a technique that Ti—Cu material is spray coated and only Cu is removed with $HNO_3$ to form a coating of a porous surface structure having a large specific surface area to thereby suppress the scattering of the adhered thin film-forming particles.

In Japanese Patent No. 3076768 is proposed a technique that a metal is sprayed onto a surface of a metal member at a metal net adhered state or a metal is sprayed and a metal net is adhered thereon and a metal is again sprayed, and thereafter the metal net is pulled out to form lattice-shaped unevenness on the spray coating, whereby the specific surface area is increased to allow the great amount of the thin film-forming particles adhered thereto.

However, the precision in the recent processing of the semiconductor becomes higher and hence the cleanness of the processing environment becomes further severer. Particularly, when the processing of the semiconductor is carried out by plasma sputtering treatment in a halogen gas or a halogen compound gas, it is required to take a countermeasure on corrosive product produced on the surface of the jig or constituent, which is arranged in the apparatus for this treatment or finer particles generated from the surface of the constituent through sputtering phenomenon.

That is, the rescattering of the thin film forming particles in the formation of the thin film comes into problem in the semiconductor processing process. Also, in the plasma etching process, not only the processing of the semiconductor but also the surrounding members are affected by the etching to generate fine particles, which is pointed out to exert on the quality of the semiconductor product. As a countermeasure therefor, JP-A-2004-52281 recommends that a quartz is used as a substrate so as to have a surface roughness of 3-18 μm and a spray coating of $Al_2O_3$ or $TiO_2$ is directly formed thereon and the surface of the spray coating is made to a roughened surface indicating a negative value of less than 0.1 as a skewness (Rsk) of a roughness curve.

Further, JP-A-2000-191370, JP-A-H11-345780, JP-A-2000-72529 and JP-B-H10-330971 disclose a technique for increasing the adhesion and deposited volume of the particles, while JP-A-2000-228398 discloses a technique of forming convex and concave portions dividing the adhered film to reduce the scattering.

in the semiconductor processing process, the conventional techniques have the following problems:

(1) Problems in the Thin Film Forming Process (a) The techniques disclosed in the above patent articles for preventing the phenomenon of adhering the thin film forming particles to the jig and constituent in the thin film forming process and the scattering thereof, i.e. the method of enlarging the adhesion area of the thin film forming particle by various means recognize a constant effect on the long-time operation for the thin film formation and the improvement of the production efficiency accompanied therewith, but the adhered and deposited thin film forming particles are finally rescattered, so that they can not be a fundamental solution.

(b) Since a surface-treated film formed or treated on the surface of the jig or constituent adhered and deposited with a great amount of the thin film forming particles is a metallic coating, when the thin film forming particles are removed with an acid or an alkali, the surface treated film is simultaneously dissolved, and hence the usable number through the reproduction becomes small, which is a cause of increasing the coat of the product.

(c) The means for enlarging the adhesion area of the thin film forming particles in the conventional techniques merely intends only the enlargement of the area, but does not propose the method of preventing the scattering of the adhered thin film forming particles.

(2) Problems in the Plasma Etching Process

As disclosed in JP-A-2004-52281, the countermeasure for the jig and constituent used in the plasma etching process proposes a technique that the spray coating of $Al_2O_3$ or $TiO_2$ is formed on the surface of quartz substrate and also the surface roughness of the spray coating is controlled to a negative value of less than 0.1 of Rsk (skewness of roughness curve), whereby fine particles generated by sputtering phenomenon is received with the surface of the coating having such a roughness curve. However, $TiO_2$ disclosed in this technique is corroded or etched under an environment of the plasma etching containing a halogen gas to produce a great amount of particles as a contamination source. On the other hand, the spray coating of $Al_2O_3$ is superior to $TiO_2$ coating in the corrosion resistance and resistance to plasma etching, but is short in the service life, and also the surface form indicating the negative value of Rsk: less than 0.1 is less in the adhesion and deposition amount of the environment contaminating substance and is saturated in a short time, so that the remaining forms a source for generating particles. Further, there is a problem that the convex portions of the surface form show a geometric form being large in the area and easily depositing a great amount of particles thereon and easily rescattering them.

As disclosed in JP-A-H10-4083, a technique of using a single crystal of $Y_2O_3$ as a material having a resistance to plasma erosion limits the application because it is difficult to form the coating of such a material. Also, a technique disclosed JP-A-2001-164354 proposing a spray coating of $Y_2O_3$ is excellent in the resistance to plasma erosion, but does not examine the adhesion and deposition of the environment contaminating particles.

SUMMARY OF THE INVENTION

It is, therefore, an object of the invention to propose a surface structure of a spray coating having an excellent resistance to plasma erosion and highly detoxifying particles adhered and deposited as a cause of contaminating a plasma treating environment and effectively preventing the rescattering.

It is another object of the invention to propose a spray coated member enhancing a semiconductor processing accuracy under a corrosive environment containing a halogen gas and stably conducting the processing over a long period of time and being effective to an improvement of a quality of a semiconductor product and a reduction of a cost as well as a method of producing the same.

The invention is solves the above problems of the conventional techniques through the following technical means:

(1) The invention provides a spray coated member having an excellent resistance to plasma erosion, characterized in that an outermost surface layer portion of a ceramic spray coated portion covering a surface of a substrate is an electron beam irradiated layer.

(2) Also, the invention provides a spray coated member having an excellent resistance to plasma erosion, characterized in that a metallic undercoat is formed on a surface of a substrate and a top coat of a ceramic spray coating is formed thereon and an outermost surface layer portion of the top coat is an electron beam irradiated layer.

(3) Further, the invention provides a method of producing a spray coated member having an excellent resistance to plasma erosion, characterized in that a spraying powder material made from a ceramic having a particle size of 5-80 μm is directly sprayed onto a surface of a substrate or onto a metallic undercoat previously formed on the surface of the substrate to form a ceramic spray coating as a top coat, and then an electron beam is irradiated onto a surface of the spray coating to fuse and solidify an outermost surface layer portion of the coating to form an electron beam irradiated layer.

In the invention, it is preferable that the electron beam irradiated layer has a structure that only a needle-like convex portion located above a center line of a roughness curve in a height direction of the surface of the coating is changed into a trapezoidal convex portion by fusion and solidification accompanied with the electron beam irradiation, and that the ceramic spray coating has a surface form that a skewness value (Rsk) of the roughness curve in the height direction mainly indicates a positive value, and that the ceramic spray coating is an oxide ceramic spray coating made from $Al_2O_3$, $Y_2O_3$ or a composite oxide of $Al_2O_3$—$Y_2O_3$, and that the ceramic spray coating has a thickness of 50-2000 μm, and that the electron beam irradiated layer is a layer changing a crystal structure of ceramic particles in the spray coating.

Since the spray coated member according to the invention does not form a source of generating particles as a cause of an environment contamination because it is excellent in the resistance to plasma erosion. Also, it is excellent in not only the characteristic of detoxifying by adsorbing a greater amount of particles on the surface of the coating to increase the deposition amount, but also the action of preventing the rescattering of the adhered and deposited particles.

Further, by adopting the member according to the invention can be enhanced the processing accuracy in the semiconductor processed products under severely corrosive environment requiring the high environmental cleanness and containing a halogen compound. Moreover, the use of such a member is made possible to conduct the continuous operation over a long time of period and to improve the quality of the precisely processed semiconductor product and reduce the cost of the product.

BRIEF DESCRIPTION OF THE DRAWINGS

The invention will be described with reference to the accompanying drawings, wherein.

DETAILED DESCRIPTION OF PREFERRED EMBODIMENTS

Figure 1:
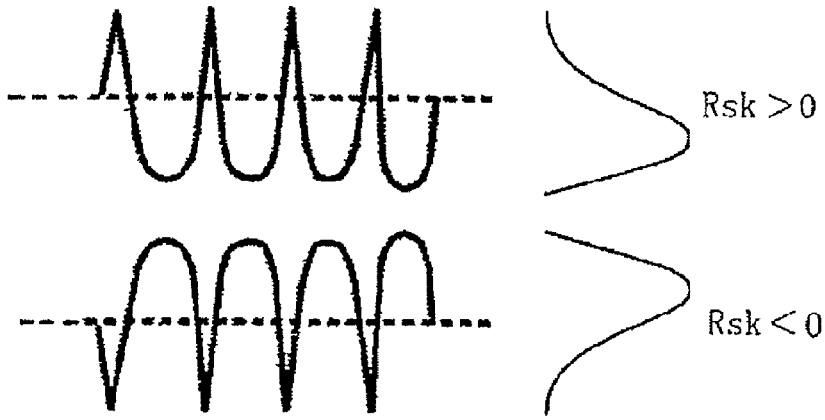
FIG. 1 is a schematic view showing a skewness value (Rsk) of a roughness curve in a thickness direction of a surface of a spray coating.

As a preferred embodiment of the invention, there is described an example of forming a ceramic spray coating (an example of "oxide ceramic" is described hereinafter) on a surface of a member in an apparatus used in a process such as a thin film forming process, a plasma etching process or the like.

(1) Formation of Oxide Ceramic Spray Coating

An oxide ceramic spray coating made from $Al_2O_3$, $Y_2O_3$ or a composite oxide of $Al_2O_3$—$Y_2O_3$ is directly formed on a surface of a substrate or on a metallic undercoat formed on the surface of the substrate at a thickness of 50-2000 μm as a top coat. When the thickness of the spray coating is less than 50 μm, the service life as the top coat becomes short, while when it exceeds 2000 μm, residual stress resulted from thermal shrinkage in the formation of the spray coating becomes large and the shock resistance of the coating and the adhesion force to the substrate lower.

The spray powder material used in the formation of the oxide ceramic spray coating is preferable to have a particle size of 5-80 μm. When the particle size is less than 5 μm, the continuous and uniform supply to a spraying gun is difficult and the thickness of the coating becomes easily non-uniform, while when it exceeds 80 μm, the material is not completely fused in a spraying heat source and the coating is formed at a so-called non-fused state and it is difficult to form the dense spray coating.

The metallic undercoat formed on the surface of the substrate prior to the formation of the top coat made of the oxide ceramic spray coating is preferable to be made of Ni and an alloy thereof, Mo and an alloy thereof, Al and an alloy thereof, Mg or the like. The undercoat is preferable to have a thickness of 50-500 μm. When the thickness is less than 50 μm, the protection of the substrate is insufficient, while when it exceeds 500 μm, the action and effect as the undercoat are saturated and the use of such an undercoat is uneconomical.

As the substrate are used Al and Al alloy, Ti and Ti alloy, stainless steel, Ni-based alloy, quartz, glass, plastics (high polymer materials), sintered member (oxide, carbide, boride, silicide, nitride and a mixture thereof), and a plated film or deposited film formed on the surface of such a substrate.

In the invention, the reason why $Al_2O_3$, $Y_2O_3$ or the composite oxide of $Al_2O_3$—$Y_2O_3$ is sprayed on the surface of the substrate as the oxide ceramic spray coating (top coat) is due to the fact that these oxide ceramics are excellent in the corrosion resistance and the resistance to plasma erosion as compared with the other oxide ceramics such as $TiO_2$, MgO, $ZrO_2$, $NiO_2$, $Cr_2O_3$ and the like.

It is preferable to form the top coat or the undercoat on the surface of the substrate by adopting an atmospheric plasma spraying process, a low pressure plasma spraying process, a water plasma spraying process, high-speed and low-speed flame spraying processes or an detonation spraying process.

(2) Surface Form of Oxide Ceramic Spray Coating (Optimum Roughness)

In the invention, the oxide ceramic spray coating directly formed on the surface of the substrate or formed on the metallic undercoat is has a surface form, i.e. a surface roughness, particularly a roughness curve in a height direction as mentioned below.

In general, the jig or constituent used in the semiconductor apparatus, for example, the plasma treating apparatus is used to have a large surface area. Because, the environment contaminating substances such as thin film forming particles, particles generated in the treating atmosphere through plasma etching and the like are adhered (adsorbed) onto the surfaces of the constituents as large as possible and at the same time the deposited state is maintained over a long time of period and also the rescattering of the adhered and deposited environment contaminating substance from the surface of the substrate is prevented.

In the invention, considering the above object, the surface form of the spray coating formed on the surface of the substrate as a top coat is specified as a skewness value (Rsk) of a roughness curve indicating a distortion in a direction of the coating thickness (height) as to a surface roughness curve of the coating. That is, by rendering the surface form into a roughened surface showing a positive value of the skewness (Rsk) is intended the increase of the adhesion and deposited amount of the environment contaminates (including particles generated in the plasma etching) and the rescattering thereof is prevented so as not to deteriorate the quality of the semiconductor processed product.

In the invention, the skewness value (Rsk) defined in geometric characteristic specification, surface properties: profile curve system, term-definition and surface parameters according to JIB B0601 (2001) is noticed as a means for specifying the surface form of the oxide ceramic spray coating.

As shown in FIG. 1, in the roughness curve wherein valley portion (concave portion) is wider than mountain portion (convex portion), the skewness value is a distribution wherein a function of probability density is biased toward the valley portion. In this case, the skewness value Rsk indicates a positive value. As Rsk becomes large at the positive side, the function of probability density is biased toward the valley side, and hence, for example, the environment contaminating substance is easily adhered to and deposited onto the valley.

On the other hand, when the skewness value is a negative value, as shown in FIG. 1, it is a roughness curve wherein the valley portion is considerably narrow, and hence the environment contaminating substance such as particles or the like is hardly adhered to the valley portion and the deposition amount becomes less.

Moreover, RsK is defined by dividing third power average of height (Z(x)) at a standard length (lr) by third power of second average root ($Rq^3$) as shown by the following equation:

$$Rsk = \frac{1}{Rq^3}\left[\frac{1}{lr}\int_0^{lr} Z^3(x)dx\right]$$

As disclosed in JP-A-2004-52281, when the surface roughness is Rsk<0, the area of the concave portion adhered and deposited with the thin film forming particles, particles and the like generated as a cause of environment contamination by the plasma etching phenomenon is small but also the distance between the valley portions is narrow, so that if the particles having a slightly larger size and the like cover the surfaces of such valley portions, the efficiency of housing the particles considerably lowers and the rescattering of the particles becomes easy.

On the contrary, when the skewness value is Rsk>0 as in the invention, as shown in FIG. 1(*a*), the area of the concave portion in the surface roughness (volume as a three dimension) is large and the adhesion amount or deposition amount of the thin film forming particles or the particles can be made large. Also, since the convex portion is sharp needle-like, it forms a form of easily introducing the particles into the concave portion. Further, the particles housed in the concave portion are hardly scattered.

Moreover, it is desirable that a ratio of indicating the positive value as the skewness value (Rsk) is not less than 80% for obtaining the above-mentioned action and effects. As a ratio of indicating the negative value becomes large, the adhesion and deposition amount of the thin film forming particles or the particles becomes less. Moreover, the control of the skewness value is carried out by controlling the particle size of the spraying powder material or controlling the spraying conditions, for example, by concretely using a mixed gas of Ar and $H_2$ as a plasma gas and a spraying angle to the substrate of 90-55°, whereby there is obtained a stable coating having the above surface form.

Further explaining in detail, the spray coating having the above surface form, i.e. the coating having a roughened surface with a given roughness curve is obtained by continuously supplying ceramic powder having a particle size of 5-80 μm at a unit of several tens of thousands particles to a heat source. In this case, all spraying powder material is located in a central portion of a high-temperature heat source (in flame) but also may be distributed in a surrounding portion of the heat source having a relatively low temperature (outside flame). Also, even if the spraying powder particles fly in the central portion of the heat source, there is produced a difference in the degree of heating fusion in accordance with the small and large particle sizes. Since the spray coating is constituted with ceramic particles having different heat histories and particle sizes, particles having different flatness are randomly deposited. As a result, the surface roughness of the spray coating is defined by the deposition of unequal particles. Therefore, when the oxide ceramic spraying powder material having a particle size of 5-80 is sprayed as a spraying powder material under predetermined spraying conditions, the skewness value of the above roughness curve can be controlled so as to mainly indicate the positive value (≧80%).

Figure 2:
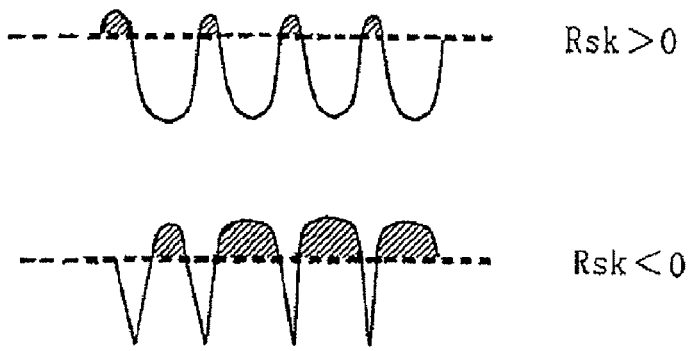
FIG. 2 is a schematic view of a roughness curve of a surface of a spray coating after irradiation of electron beam in which a shadowed portion shows a fused and solidified portion by the irradiation of electron beam.

In the surface roughness of the above spray coating surface represented by Rsk>0, as shown in FIG. 1, the form of the convex portion is sharp needle-like, so that there is caused a fear that the convex portions are preferentially sputtered in the plasma etching environment to deteriorate the resistance to plasma etching. In the invention, therefore, an electron beam is irradiated to the surface of the spray coating made of $Al_2O_3$, $Y_2O_3$ or $Al_2O_3$—$Y_2O_3$ composite oxide to fuse and solidify the spraying particles, whereby an outermost surface layer portion of the spray coating (0.5-5 μm), i.e. needle-like convex portions located above the center line of the skewness value shown by the roughness curve is changed into a trapezoidal convex form as shown in FIG. 2.

When the electron beam is irradiated to the surface of the oxide ceramic spray coating, the rescattering of the particles causing the contamination in the atmosphere can be suppressed without lowering the adhesion and deposition volumes of the particles, whereby the spray coating itself shows a good resistance to plasma erosion. Therefore, the spray coating irradiated to the electron beam solves the drawbacks of the conventional techniques bringing about the source of generating the environment contaminating particles.

When the spray coating having a surface form of Rsk>0 shown in FIG. 1 is subjected to the irradiation of the electron beam, the needle-like convex portions in the roughness curve are preferentially fused by the concentration of the beam energy to change the initial sharp needle-like convex portion into a round trapezoidal convex portion. When the effect of the electron beam irradiation is made to stop at a position of the center line of the surface roughness curve in the height direction, the large-opening concave portions existing at a position lower than the center line of the roughness curve are not influenced by the irradiation of the electron beam and can maintain the form for adhering and depositing a great amount of environment contaminating particles as they are.

Namely, the surface of the spray coating is subjected to the irradiation of the electron beam, only the needle-like convex portions with the surface form having Rsk>0 as a skewness value of a roughness curve are fused to change into the trapezoidal form, whereby the formation and scattering of the fine particles as a cause of environment contamination under an action of plasma erosion can be prevented. On the other hand, the form of the concave portions below the center line can be maintained as it is. Moreover, when the electron beam is irradiated so as to extend below the center line of the surface roughness curve, the concave portions suitable for adhering and depositing the great amount of the particles are fused and hence the whole of the coating becomes flat and smooth, and as a result, the unevenness inherent to the spray coating can not be utilized effectively.

Among the surfaces of the spray coating, the concave form appearing below the center line is not influenced even in the portions indicating Rsk<0 as a skewness value of the roughness curve, so that the electron beam is irradiated only to the portions inclusive of round convex portions located above the center line of the roughness curve in the height direction. In this case, the same effect as in the case of the coating having a form of Rsk>0, but the convex portions above the center line are fused and solidified by the irradiation of the electron beam and changed into a different crystal form, and hence the occurrence of particles from the oxide ceramic spray coating in the irradiation of the electron beam can be suppressed.

Also, when the electron beam is irradiated to the surface of the oxide ceramic spray coating, the crystal structure of the oxide ceramic, i.e. $Al_2O_3$, $Y_2O_3$ or composite oxide of $Al_2O_3$—$Y_2O_3$ can be changed to improve the resistance to plasma erosion as compared with the coating prior to the electron beam irradiation. This effect supplements the problem that the spray coating itself becomes a source of generating the environment contaminating particles under the action of the plasma erosion.

When the electron beam is irradiated onto the surface of the oxide ceramic spray coating, the crystal structure of the coating component changes into a more stabilizing direction as a result of the inventors' knowledge. That is, in case of $Al_2O_3$, the crystal structure of the coating after the spraying is γ-phase, but changes into α-phase after the irradiation of the electron beam. The crystal structure of $Y_2O_3$ changes from a cubic crystal through a monoclinic crystal to a cubic crystal, while the crystal structure of the $Al_2O_3$—$Y_2O_3$ composite oxide changes so as to possess the above changes of $Al_2O_3$ and $Y_2O_3$ with each other. In any changes, the resistance to plasma erosion is improved.

Moreover, as a method of fusing a portion of the spray coating located above the center line of the skewness value Rsk for changing the needle-like convex portion having the predetermined skewness value (Rsk) into the trapezoidal convex portion, it is recommended that the irradiation power and irradiation number as an irradiation condition of the electron beam are controlled within the following range in accordance with the thickness of the spray coating (50-2000 μm):

| | |
|---|---|
| Irradiation atmosphere: | Ar gas of 10-0.005 Pa |
| Irradiation power: | 10-10 KeV |
| Irradiation rate: | 1-20 m/s |

As another method adopting irradiation conditions other than the above conditions, an electron beam is generated by an electron gun or the irradiation atmosphere is made under a reduced pressure or in an inert gas of a reduced pressure, whereby it is possible to finely adjust the irradiated layer.

In the invention, the meaning and merits of subjecting the surface of the oxide ceramic spray coating to the irradiation of the electron beam are mentioned as follows:

(a) As the oxide ceramic spray coating, in addition to $Al_2O_3$, $Y_2O_3$ or the composite oxide of $Al_2O_3$—$Y_2O_3$, the other ceramic coatings such as $3Al_2O_3$-$2SiO_2$, $ZrO_2$, $Cr_2O_3$ and the like can be utilized, so that the application is considerably wider.

(b) The electron beam irradiation is carried out to the convex portions of the roughness curve irrespectively of the form of the roughness curve (skewness value) in the height direction of the surface of the spray coating, so that the physical and chemical properties of the coating as a whole are not influenced.

(c) The convex portion on the surface of the spray coating irradiated by the electron beam is changed from the sharp needle-like form into the round trapezoidal form by local fusion-solidification reaction, so that it is hardly affected by the action of plasma etching. Also, the crystal structure is changed into a more stable structure, so that the convex portion can be modified and the service life can be prolonged in view of the crystal structure level.

(d) Since the portion irradiated by the electron beam is limited to only the convex portions in the outermost surface layer of the spray coating, the characteristics of the form in the concave portions below the center line of the roughness curve, concretely the form capable of depositing a great amount of environment contaminating particles as in the concave form of the roughness curve represented by Rsk>0 can be maintained as they are.

(e) In the convex portions on the surface of the spray coating irradiated by the electron beam, the resistance to plasma erosion is improved by the effects such as the change of crystal structure through the fusion-solidification reaction and the like. Also, they do not form a source of generating particles as a cause of environment contamination, so that the precise processing operation of the semiconductor can be smoothly conducted while maintaining a higher environmental cleanness.

Example 1

In this example, a coating of $Al_2O_3$, $Y_2O_3$ or $Al_2O_3$—$Y_2O_3$ composite oxide is directly formed on a surface of SUS304 substrate (40 mm in width×50 mm in length×7 mm in thickness) at a thickness of 120 μm by a plasma spraying process, and thereafter the surface thereof is subjected to the measurement of skewness value in the height direction of the coating surface by means of a roughness measuring meter of SURFCOM 1400D-13 (made by Tokyo Seimitsu Co., Ltd.) to distinct into coating of Rsk>0 and coating of Rsk<0. These coatings are subjected to or not to an irradiation of an electron beam to prepare test specimens.

With respect to these test specimens, the following items are examined by means of a reactive plasma etching apparatus having a plasma irradiating power of 80 W.

(1) Resistance to Plasma Etching

The surface of the test specimen is etched by flowing a mixed gas of $CF_4$ gas (60 ml/min) and $O_2$ gas (2 ml/min) into the plasma etching apparatus for 800 minutes, and thereafter observed by means of an electron microscope to evaluate the resistance to plasma etching.

(2) Deposition State of Particles

As a source of generating environment contaminating particles, there is separately provided a $SiO_2$ spray coating to be easily plasma-etched. This coating is regarded as environment contaminating particles by plasma etching and placed in the plasma etching apparatus. The state of adhering and depositing these particles on the test specimen is observed by means of an electron microscope.

(3) Rescattering of Environment Contaminating Particles

The test specimen after the above test (2) is heated in an argon gas (Ar) atmosphere at 300° C. for 15 minutes and cooled to room temperature. After this operation is repeated 10 times, the surface of the test specimen is observed by means of an electron microscope to examine the remaining state of the adhered particles.

The results are summarized in Table 1. As to the resistance to plasma etching, all coatings of $Al_2O_3$, $Y_2O_3$ and $Al_2O_3$—$Y_2O_3$ composite oxide irradiated by the electron beam develop a good resistance to plasma etching as compared with the non-irradiated coatings without relation to the case that the form of the surface roughness curve is Rsk>0 or Rsk<0. Concretely, $Y_2O_3$ coating of Rsk>0 (No. 6) and $Y_2O_3$ coating (No. 8), $Al_2O_3$—$Y_2O_3$ composite oxide coating (Nos. 10 and 12) of Rsk<0, which are not subjected to the electron beam irradiation, develop fairly good resistance to plasma etching as compared with $Al_2O_3$ coating. However, when the electron beam is irradiated to these coatings, the more improvement of the resistance to plasma etching is obtained.

Viewing the deposition state of particles, the coating of Rsk>0 having a sharp convex form of the roughness curve and a large concave volume is recognized to have a great amount of particles deposited irrespectively of the kind of the coating material, which is considered that the effect of the coating surface form is a most important factor. However, the effect of depositing the particles is recognized even in the irradiation of the electron beam (Nos. 1, 3, 5, 7, 9, 11), so that when the degree of rescattering the particles adhered and deposited on the surface of the test specimen is examined by the behavior of expansion and shrinkage in the substrate metal and the oxide ceramic coating accompanied with the change of the environment temperature, it has been confirmed that the coating of Rsk>0 as a skewness value of the roughness curve of the coating surface is less in the rescattering but the tendency of the rescattering is large in the coating of Rsk<0 irrespectively of the presence or absence of the electron beam irradiation. The reason why the effect of rescattering the particles is low even when the coating of Rsk>0 is irradiated by the electron beam (Nos. 1, 5, 9) is considered due to the fact that the electron beam is irradiated to only the convex portions of the roughness curve and does not affect the concave form having a large deposition volume of the particles.

As seen from the above results, the effect of the electron beam irradiation is recognized on both of Rsk>0 and Rsk<0 in the form of the roughness curve on the surface of the oxide ceramic spray coating though there is a some difference, from which it is thought that the coating of $Al_2O_3$, $Y_2O_3$ or $Al_2O_3$—$Y_2O_3$ composite oxide improves the resistance to plasma erosion through the electron beam irradiation and can solve the drawback of forming the source of generating particles.

TABLE 1

| No. | Substrate | Coating Material | Form of roughness curve in coating surface | Electron beam irradiation | Results of coating surface: Plasma etching | State of particles deposited | State of rescattering particles | Remarks |
|---|---|---|---|---|---|---|---|---|
| 1 | SUS304 steel | $Al_2O_3$ | Rsk > 0 | presence | ◎ | ○ | ○ | Invention Example |

TABLE 1-continued

| No. | Substrate | Coating Material | Form of roughness curve in coating surface | Electron beam irradiation | Results of coating surface: Plasma etching | State of particles deposited | State of rescattering particles | Remarks |
|---|---|---|---|---|---|---|---|---|
| 2 | | | | Absence | Δ | ○ | ○ | Invention Example |
| 3 | | | Rsk < 0 | presence | ◎ | Δ | Δ | Invention Example |
| 4 | | | | Absence | Δ | Δ | Δ | Comparative Example |
| 5 | | $Y_2O_3$ | Rsk > 0 | presence | ◎ | ○ | ○ | Invention Example |
| 6 | | | | Absence | ○ | ○ | ○ | Invention Example |
| 7 | | | Rsk < 0 | Presence | ◎ | Δ | Δ | Invention Example |
| 8 | | | | absence | ○ | Δ | Δ | Comparative Example |
| 9 | | $Al_2O_3$—$Y_2O_3$ composite oxide | Rsk > 0 | presence | ◎ | ○ | ○ | Invention Example |
| 10 | | | | absence | ○ | ○ | ○ | Invention Example |
| 11 | | | Rsk < 0 | presence | ◎ | Δ | Δ | Invention Example |
| 12 | | | | absence | ○ | Δ | Δ | Comparative Example |

(Remarks)
(1) Thickness of spray coating is 120 μm
(2) Evaluation in column of plasma etching Δ: fairly large etching, ○: presence of etching phenomenon, ◎: slight etching
(3) Evaluation in column of particle deposition Δ: large adhesion, ○: small adhesion
(4) Evaluation in column of particle rescattering Δ: large rescattering, ○: small rescattering

Example 2

In this example, an undercoat of 80 mass % Ni-20 mass % Cr is formed on a surface of Al substrate (30 mm in width×50 mm in length×5 mm in thickness) at a thickness of 80 μm and a coating of $Al_2O_3$, $Y_2O_3$ or $Al_2O_3$—$Y_2O_3$ composite oxide is formed thereon at a thickness of 250 μm through a plasma spraying process, respectively. Thereafter, Rsk value of roughness curve on the surface of the spray coating is measured by means of the aforementioned roughness meter to distinct Rsk>0 and Rsk<0, which are subjected to an irradiation of electron beam.

These spray coating specimens are subjected to plasma etching under the following conditions, the number of particles scatted by the etching action is compared with the number of particles adhered on a surface of a silicon wafer having a diameter of 3 inches arranged in the same apparatus. Moreover, the number of the adhered particles is examined by a surface inspection apparatus (magnifying glass), in which particle size of not less than about 0.2 μm is targeted.

(1) Atmosphere Gas Condition $CHF_3$ 80:$O_2$ 100:Ar 160 (numeral is a flow rate $cm^3$ per 1 minute)

(2) Plasma Irradiation Power

| | |
|---|---|
| High frequency power: | 1300 W |
| Pressure: | 4 Pa |
| Temperature: | 60° C. |

In this experiment, the coating not irradiated by the electron beam and oxide ceramic coatings of $TiO_2$ and 8 mass % $Y_2O_3$-92 mass % $ZrO_2$ as a comparative example are tested under the same conditions.

The experimental results are shown in Table 2. As seen from these results, $TiO_2$ (No. 14) and 8 mass % $Y_2O_3$-92 mass % $ZrO_2$ (No. 18) as the comparative example exceed the control value of 30 particles in the plasma irradiation test of 1.8 hours and 3.2 hours, respectively, and are poor in the resistance to plasma erosion. On the contrary, the coating of $Al_2O_3$, $Y_2O_3$ or $Al_2O_3$—$Y_2O_3$ composite oxide suitable for the invention develops the excellent resistance to plasma erosion as compared with the coatings of the comparative example. Particularly, the coatings irradiated by the electron beam (Nos. 1, 3, 5, 7, 9, 11) show a more excellent resistance to plasma erosion as compared with the coatings not irradiated by the electron beam (Nos. 2, 4, 6, 8, 10, 12).

As seen from the above results, the electron beam irradiation is particularly effective for the spray coatings having a certain resistance to plasma erosion at a sprayed state, and is an effective treatment not largely exerting on the form (Rsk>0, Rsk<0) of the roughness curve on the surface of the coating.

TABLE 2

| No. | Substrate | Coating material (top coat) | Form of roughness curve in coating surface | Electron beam irradiation | Time arriving at control value of particles (h) | Remarks |
|---|---|---|---|---|---|---|
| 1 | Al aluminum | $Al_2O_3$ | Rsk > 0 | presence | ≧80 | Invention Example |
| 2 | | | | absence | 40 | Comparative Example |
| 3 | | | Rsk < 0 | presence | ≧80 | Invention Example |
| 4 | | | | absence | 43 | Comparative Example |
| 5 | | $Y_2O_3$ | Rsk > 0 | presence | ≧80 | Invention Example |
| 6 | | | | absence | 70 | Comparative Example |
| 7 | | | Rsk < 0 | presence | ≧80 | Invention Example |
| 8 | | | | absence | 73 | Comparative Example |
| 9 | | $Al_2O_3$—$Y_2O_3$ composite oxide | Rsk > 0 | presence | ≧80 | Invention Example |
| 10 | | | | absence | 55 | Comparative Example |
| 11 | | | Rsk < 0 | presence | ≧80 | Invention Example |
| 12 | | | | absence | 60 | Comparative Example |
| 13 | | $TiO_2$ | Rsk > 0 | presence | 2.0 | Comparative Example |
| 14 | | | | absence | 1.8 | Comparative Example |
| 15 | | | Rsk < 0 | presence | 2.2 | Comparative Example |
| 16 | | | | absence | 2.0 | Comparative Example |
| 17 | | 8mass % $Y_2O_3$—92mass % $ZrO_2$ | Rsk > 0 | presence | 3.7 | Comparative Example |
| 18 | | | | absence | 3.2 | Comparative Example |
| 19 | | | Rsk < 0 | presence | 3.8 | Comparative Example |
| 20 | | | | absence | 3.5 | Comparative Example |

(1) As the structure of the spray coating, an undercoat (80 mass % Ni—20 mass % Cr) is 80 μm and a top coat is 250 μm.
(2) Control value of particles = value of 30 particles having a size of not less than 0.2 μm adhered onto silicon wafer

Example 3

In this example, all test specimens used in the test of Example 2 for the resistance to plasma erosion are subjected to a thermal shock test. That is, the test specimen of the spray coating used in the test of Example 2 was subjected to the plasma erosion test under a corrosive environment containing a halogen gas, during which the corrosive halogen gas penetrated through pores of the top coat into the interior of the coating and may corrode the undercoat to easily peel off the top coat.

In the thermal shock test, the test specimen is heated in an electric furnace of 300° C. for 15 minutes and thereafter cooled in air of 24° C. for 20 minutes, and such an operation is repeated 10 times. Thereafter, the change of the top coat is visually observed. As a result, it has been confirmed that all test specimens shown in Table 2 hold a good resistance to thermal shock without causing the cracking of the top coat and the peeling of the coating.

The invention is applicable as a member used in a technical filed of semiconductor processing apparatus, thin film forming apparatus or the like such as members for vacuum vessel used in vacuum deposition, ion plating, sputtering, chemical deposition, laser precision processing, plasma sputtering and the like.

Since this invention is excellent about the action of preventing the adhesion and the deposition of particles and about the action of inhibiting the rescattering, it is possible to use in the field of the member for the semiconductor processing and also the field of the one of the members for precision processing and the structural member thereof (the wall at the working chamber) and the like.

What is claimed is:

1. A spray coated member having resistance to plasma erosion, comprising a ceramic spray coated portion covering a surface of a substrate wherein an outermost surface layer portion of the ceramic spray coated portion is an electron beam irradiated layer, wherein only sharp-end convex portions located above a center line of a roughness curve in a height direction of a surface of the ceramic spray coated portion are changed into rounded convex portions by fusion-solidification accompanied with an irradiation of the electron beam;

the ceramic spray coated portion has a surface form that a skewness value (Rsk) of a roughness curve in the height direction according to JIS B0601 is greater than 0; and the ceramic spray coated portion has a thickness of 50-2000 μm, wherein the ceramic spray coated portion is an oxide ceramic spray coating made of $Al_2O_3$, $Y_2O_3$ or $Al_2O_3$—$Y_2O_3$ composite oxide.

2. A spray coated member according to claim 1, wherein the electron beam irradiated layer is a layer made of a changed crystal structure of ceramic particles of the spray coated portion.

3. A spray coated member having resistance to plasma erosion, comprising a metallic undercoat formed on a surface of a substrate and a top coat of a ceramic spray coating formed thereon, wherein an outermost surface layer portion of the top coat is an electron beam irradiated layer, wherein only sharp-end convex portions located above a center line of a roughness curve in a height direction of a surface of the ceramic spray coating is changed into rounded convex portions by fusion-solidification accompanied with an irradiation of the electron beam; and the ceramic spray coating has a surface form that a skewness value (Rsk) of a roughness curve in the height direction according to JIS B0601 is greater than 0 and has a thickness of 50-2000 μm, wherein the ceramic spray coating is an oxide ceramic spray coating made of $Al_2O_3$, $Y_2O_3$ or $Al_2O_3$—$Y_2O_3$ composite oxide.

4. A spray coated member according to claim 3, wherein the electron beam irradiated layer is a layer made of a changed crystal structure of ceramic particles of the spray coating.

* * * * *